US010309004B2

(12) United States Patent
Baumgart et al.

(10) Patent No.: US 10,309,004 B2
(45) Date of Patent: Jun. 4, 2019

(54) METAL SHEET AND METHOD FOR ITS TREATMENT

(71) Applicant: GM GLOBAL TECHNOLOGY OPERATIONS LLC, Detroit, MI (US)

(72) Inventors: Hartmut Baumgart, Bischofsheim (DE); Ronald Sanders, Daxweiler (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 754 days.

(21) Appl. No.: 14/802,453

(22) Filed: Jul. 17, 2015

(65) Prior Publication Data

US 2016/0017476 A1 Jan. 21, 2016

(30) Foreign Application Priority Data

Jul. 18, 2014 (DE) ..... 10 2014 010 661

(51) Int. Cl.

| | |
|---|---|
| ***C23C 8/80*** | (2006.01) |
| ***C23C 10/60*** | (2006.01) |
| ***C23C 10/28*** | (2006.01) |
| ***C23C 8/04*** | (2006.01) |
| ***C23C 10/04*** | (2006.01) |
| ***C23C 8/66*** | (2006.01) |
| ***C23C 8/72*** | (2006.01) |
| ***B41M 7/00*** | (2006.01) |

(Continued)

(52) U.S. Cl.

CPC ..... *C23C 10/28* (2013.01); *B41M 7/009* (2013.01); *C23C 8/04* (2013.01); *C23C 8/66* (2013.01); *C23C 8/72* (2013.01); *C23C 10/04* (2013.01); *C23C 10/60* (2013.01); *B41M 1/10* (2013.01); *B41M 1/12* (2013.01)

(58) Field of Classification Search

None

See application file for complete search history.

(56) References Cited

U.S. PATENT DOCUMENTS 3,668,917 A * 6/1972 Komatsu ..... B21J 5/00 148/580

4,042,427 A 8/1977 Razim et al.

(Continued)

FOREIGN PATENT DOCUMENTS

DE 1925029 C3 6/1980

DE 19650258 A1 6/1998

(Continued)

OTHER PUBLICATIONS

United States Patent Office, United States Office Action for U.S. Appl. No. 15/347,283, dated Apr. 25, 2017.

(Continued)

*Primary Examiner* — George Wyszomierski

(74) *Attorney, Agent, or Firm* — Lorenz & Kopf, LLP

(57) ABSTRACT

A method for treating sheet metal is disclosed in which a material containing at least one alloying element is applied onto a first area of at least one surface of the metal sheet. A second area of the surface is kept free of the material. The metal sheet is subsequently heat treated in order to diffuse the alloying element into the first area of the metal sheet. The temperature of the first area is lower than the melting temperature of the metal sheet during the diffusion.

8 Claims, 3 Drawing Sheets

(51) Int. Cl.

| | |
|---|---|
| *B41M 1/10* | (2006.01) |
| *B41M 1/12* | (2006.01) |

(56) References Cited

U.S. PATENT DOCUMENTS

| | | | | |
|---|---|---|---|---|
| 4,321,098 | A * | 3/1982 | Hayden | C21D 9/525 148/596 |
| 4,834,806 | A * | 5/1989 | Hashimoto | B23K 35/3033 148/403 |
| 5,094,699 | A * | 3/1992 | Feichtinger | B23K 20/16 148/207 |
| 5,735,163 | A | 4/1998 | Sato et al. | |
| 6,554,924 | B2 | 4/2003 | Morrow et al. | |
| 6,602,550 | B1 * | 8/2003 | Grant | C23C 10/04 427/252 |
| 8,215,147 | B2 * | 7/2012 | Horton | B21J 13/02 148/654 |
| 8,722,203 | B2 | 5/2014 | Laurent et al. | |
| 2002/0092587 | A1 | 7/2002 | Morrow et al. | |
| 2006/0222880 | A1 | 10/2006 | Hanlon | |
| 2007/0044792 | A1 * | 3/2007 | Ivri | A61M 11/005 128/200.14 |
| 2010/0007206 | A1 | 1/2010 | Wodrich | |
| 2011/0300374 | A1 * | 12/2011 | Feng | C23C 2/02 428/332 |
| 2014/0345753 | A1 | 11/2014 | Bors | |
| 2016/0017457 | A1 | 1/2016 | Baumgart et al. | |

FOREIGN PATENT DOCUMENTS

| | | | |
|---|---|---|---|
| DE | 10038139 | A1 | 2/2002 |
| DE | 102008003871 | A1 | 7/2009 |
| DE | 102009023195 | A1 | 12/2010 |
| DE | 102010035339 | B4 | 5/2012 |
| DE | 102009042387 | B4 | 1/2013 |
| DE | 102013216317 | A1 | 2/2015 |
| EP | 0345936 | A1 | 12/1989 |
| JP | S53109882 | A | 9/1978 |
| JP | S5947372 | A | 3/1984 |
| JP | S62253778 | A | 11/1987 |
| JP | H01100710 | A | 4/1989 |
| JP | 2007116181 | A | 5/2007 |
| WO | 2015179747 | A1 | 11/2015 |

OTHER PUBLICATIONS

German Patent Office, German Search Report for German Application No. 102015014490.1, dated Nov. 23, 2016.

* cited by examiner

METAL SHEET AND METHOD FOR ITS TREATMENT

CROSS-REFERENCE TO RELATED APPLICATION

This application claims priority to German Patent Application No. 102014010661.6, filed Jul. 18, 2014, which is incorporated herein by reference in its entirety.

TECHNICAL FIELD

The present disclosure pertains to a method for treating sheet metal, treated metal sheets obtained by the method, as well as products made of the treated metal sheets.

BACKGROUND

Methods for treating sheet metal, which in sections have locally modified properties, are generally known. Sheet metal parts with locally modified properties can be produced by locally alloying in corresponding alloying elements. DE 196 50 258 A1 describes a method for alloying metal sheets, in which alloying components are supplied in the form of a wire and the contact area between the wire and the metal sheet is heated by means of a laser. Even if the metal sheet and the wire are fused in the contact area in order to quickly form the alloy in the contact area, this method is time-consuming because the wire and the laser beam must be successively moved to and process each contact area to be alloyed. The greater the proportion of the area to be alloyed in the overall surface of the metal sheet, the longer it takes to process a metal sheet with the known method and the more uneconomical this method becomes.

SUMMARY

In accordance with the present disclosure, a cost-efficient method for selectively alloying a metal sheet in an area of its surface and in which the duration of the method does not increase with the proportion of the area to be alloyed in the overall surface of the metal sheet. According to an embodiment for treating sheet metal, a material containing at least one alloying element is applied onto a first area of at least one surface of the metal sheet. A second area of the surface is kept free of the material. The sheet metal is subsequently heat-treated in order to diffuse the alloying element into the first area of the metal sheet. The temperature of the first area during the diffusion is lower than the melting temperature of the metal sheet.

Since the heat treatment affects the entire metal sheet, the alloy formation can take place simultaneously in the entire first area covered with the material. Consequently, the duration of the treatment is on the one hand not dependent on the proportion of the first area in the overall surface of the metal sheet, and significantly more time for forming the alloy at each point of the first area than in a heating process by means of laser scanning is on the other hand available. In this way, the alloy formation can take place at a temperature slightly below the melting point of the metal sheet, at which the shape of the metal sheet is preserved. The material may be applied linearly, as well as over surface areas such that the shape of the sheet metal surface area covered by the material is not restricted in any way. Consequently, the position, the size or the arrangement of the area alloyed by means of the heat treatment also is not subject to any restrictions. The heat treatment may take place in a furnace.

The further processing of the metal sheet into a finished or semi-finished product usually includes forming the metal sheet. In order to save time, this step can be carried out in a cooling phase of the metal sheet that follows the alloying process. The cooling phase may include transferring heat from the metal sheet to a colder forming tool that is in contact with the metal sheet during the forming process.

The material may consist of an amorphous mass. The consistency of the amorphous mass may be chosen such that the material can be applied by printing on the amorphous mass, particularly by means of gravure or screen printing, or by spraying on the amorphous mass. The material may also include a solid that is preformed into the shape of the first area and then applied onto the metal sheet. The material may also include a foil such as a metal foil that contains the alloying element. It would also be conceivable to apply the material onto a carrier foil that is placed onto the metal sheet.

The alloying element of the amorphous mass may be chosen such that the first area of the metal sheet is provided with a higher load characteristic than the unalloyed metal sheet or the second area that remains unalloyed. In this way, the strength, the hardness or the moduli of elasticity in the first area are increased due to the alloying process. The weldability of the metal sheet can be reduced in the first area due to the alloying process. Since the weldability in the second area is preserved, the partition of the metal sheet into first and second areas should be defined in such a way that all welded joints between the finished metal sheet and other components are in a finished product accommodated in the second area. This can occur, in particular, with steel sheets, to which carbon or an element that increases the carbon equivalent was added by alloying. Due to the lower hardness of the second area, it is also advantageous to localize connections to other components in the second area when other fastening techniques such as screws, rivets, crimping, etc., are used.

The metal sheet may include a steel sheet and the alloying element may be selected from a group including carbon, nitrogen, manganese, silicon, nickel, chrome or a combination thereof. The above-described adverse effect on the weldability can occur with a steel sheet, in particular, if the introduced alloying element includes carbon. The metal sheet may include an aluminum sheet, and the alloying element may be selected from the group including copper, zinc, magnesium, silicone, manganese, lithium or combinations thereof.

In a product that is assembled of several components, one of the components may include a metal sheet of the above-described type or a metal sheet treated in the above-described method. Another component may include an attachment part that is fastened on the second area of the metal sheet. In this case, the superior welding properties of the second area can be advantageously utilized for producing welded joints and the greater ductility of the second area can be advantageously utilized in mechanical deformation-type joining methods.

The standard potential of the metal sheet can also be modified in the first area by alloying in the alloying element from the material. In a product assembled of several components, this effect can be utilized in that the standard potential of the first area is approximated to or even matched with the standard potential of the attachment part by adding a suitable alloying element. In this way, the risk of contact corrosion can be minimized when the first area contacts the attachment part.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
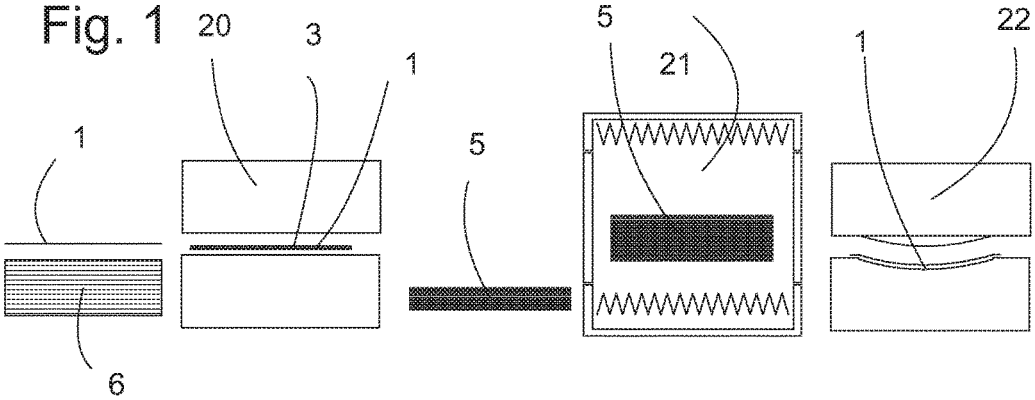
FIG. 1 schematically shows the treatment of metal sheets according to a first embodiment of the method.

FIG. 1 schematically shows different stages of the inventive method. In a first stage, which is illustrated in the left portion of FIG. 1, the metal sheet 1 to be processed lies on a stack 6 in the form of a flat, plate-shaped sheet metal blank 1. The metal sheet 1 may be a low alloy steel, preferably IF-steel.

In FIG. 1, a screen printing machine 20 is arranged on the right side adjacent to the sheet metal stack 6 and an individual sheet metal blank 1 from the stack 6 is inserted into said screen printing machine 20. An amorphous mass 3 is applied onto a first area of a surface of each sheet metal blank 1 in this screen printing machine 20. The amorphous mass 3 contains one or more alloying elements in the form of a powder suspended in a liquid that, if applicable, is mixed with a binder. The alloying element may be selected from a group of alloying elements. For example, the alloying element may be carbon if the metal sheet 1 is a steel sheet. However, the group may include carbon, nitrogen, manganese, silicone, chrome, nickel or combinations thereof. The alloying element may be different if the metal sheet 1 includes a different metal. For example, the alloying element may be selected from the group including copper, zinc, magnesium, silicone, manganese, lithium or combinations thereof, if the metal sheet 1 is an aluminum sheet. The particles of the powder may contain the alloying element in pure form or in the form of a compound that releases the alloying element under suitable external influences, particularly under the influence of heat. If several alloying elements are provided, the particles of the powder may consist of an alloy of the different alloying elements or the powder may consist of a mixture of particles that respectively contain one of the alloying elements. The alloying elements generally are purposefully selected in order to modify certain properties of the metal sheet such as its load characteristic or standard potential in the alloyed first area 2. In this regard, the choice of suitable elements depends on the material of the metal sheet in each individual instance.

Figure 2:
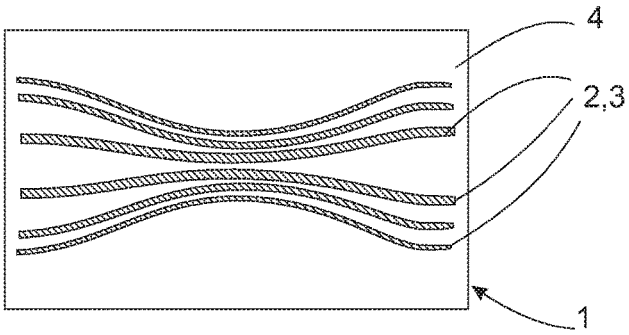
FIG. 2 shows a top view of a metal sheet processed in the method according to FIG. 1.
Figure 3:
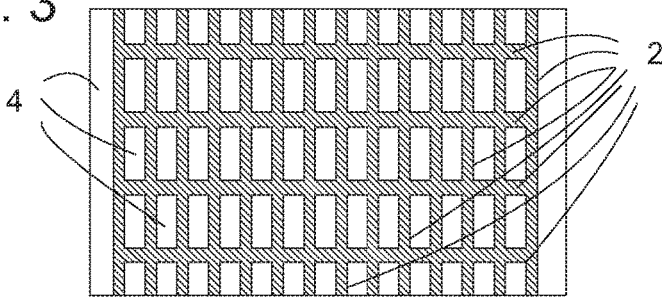
FIG. 3 shows a top view of a variation of the metal sheet.
Figure 4:
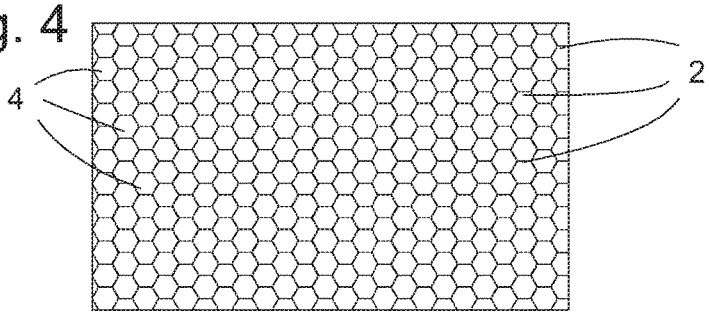
FIG. 4 shows a top view of another variation of the metal sheet.

FIGS. 2-4 show exemplary distributions of the amorphous mass 3 on the surface of the metal sheet 1. A first area 2 is covered by the amorphous mass 3 while a second area 4 is kept free of the mass 3. In FIG. 2, the first area 2 is composed of several separated strips. In FIG. 3, the first area includes strips that perpendicularly intersect one another and form a regular pattern of small sections. In FIG. 4, the first area consists of a grid between hexagons that form the second area 4.

FIG. 1 shows a stack 5, on which the already printed sheet metal blanks 1 are deposited, on the right side adjacent to the screen printing machine 20. After the application of the amorphous mass 3 onto the sheet metal blanks 1, the stack 5 is subjected to a heat treatment in a top hat furnace 21. The alloying elements from the amorphous mass 3 are diffused into the first area 2 of the metal sheet 1 in a diffusion annealing process. In this case, an alloy of the sheet metal material and the alloying elements contained in the mass 3 is produced in the first area 2, while the second area 4 remains unalloyed. If possible, the time and the temperature of the diffusion annealing process are adjusted in such a way that complete diffusion of the alloying elements from the mass 3 into the metal sheet 1 is achieved.

If the printed sheet metal blanks 1 are stacked on the stack 5 before the amorphous mass 3 on their upper side has dried, the amorphous mass may be transferred from a blank 1 to the underside of a blank 1 stacked thereon and alloyed areas may also be formed on the underside of the blanks during the subsequent annealing process. If this is undesirable, the mass 3 can be dried before the blanks are stacked or the blanks 1 are individually transferred into the top hat furnace 21 in order to be subjected to the heat treatment.

Figure 5A:
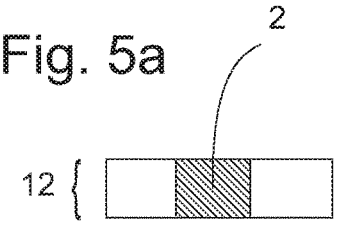
FIG. 5*a* shows a distribution of an alloying element through a cross section of the metal sheet.
Figure 5B:
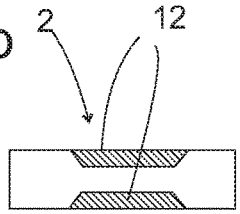
FIG. 5*b* shows a distribution of an alloying element through a portion of a cross section of the metal sheet.

The distribution of the alloying elements over the thickness of the sheet metal in the first area 2 is dependent on the temperatures and the duration of the heat treatment. A uniform distribution of the alloying elements in the first area 2 originating from the amorphous mass 3 over the entire thickness of the metal sheet in accordance with FIG. 5*a* is particularly desirable if the property to be modified is a bulk property of the metal sheet such as, e.g., a load characteristic. In order to achieve such a uniform distribution, it may be helpful to apply the amorphous mass 3 onto both sides, if applicable, by stacking the sheet metal blanks 1 in the above-described fashion. A concentration of the alloying elements on a surface layer 12 on one or both sides of the first area 2 in accordance with FIG. 5*b* is advantageous when the property to be modified is a surface property such as, e.g., the standard potential.

If the metal sheet 1 includes a steel material and the alloying element is carbon, increased strength can be achieved in the alloyed first area 2 in dependence on the alloying composition by quenching the metal sheet after the diffusion annealing process. If applicable, the deformation properties can be improved by means of a subsequent tempering process. For this purpose, the stack 5 is conventionally quenched from the temperature of the diffusion annealing process. In a second stage of the heat treatment, the stack 5 is subjected to a tempering treatment in the top hat furnace 21. The choice of the quenching medium, the quenching conditions and the tempering conditions conventionally depend on the steel material and the properties to be achieved. The march of temperature and the duration of the heating and soaking phases depend on the dimensions of the stack 5 and the sheet metal thickness. In accordance with the base material and/or the applied alloying elements, the heat treatment preferably takes place under an inert gas atmosphere, for example nitrogen, in order to preclude undesirable reactions with atmospheric oxygen. A reducing atmosphere may also be considered, in particular, if the base material consists of aluminum.

On the right side, FIG. 1 shows a metal sheet 1 that is placed into a forming tool 22 directly from the furnace heat and hot-formed therein. In this way, the pre-heating phase of the hot-forming process can be eliminated. After the heat treatment, the sheet metal blank 1 is cooled in the forming tool 22.

Figure 6:
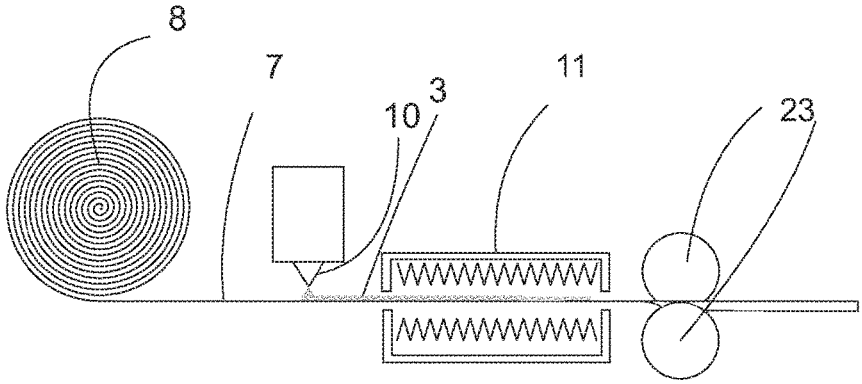
FIG. 6 shows the treatment of sheet metal according to a second embodiment of the method.

FIG. 6 shows the treatment of sheet metal according to a second embodiment of the method. In this case, the sheet metal to be processed is initially supplied in the form of a sheet metal strip 7, which is wound into a coil 8 as illustrated in the left portion of FIG. 6. The sheet metal strip 7 is gradually unwound from the coil and passes one or more spray nozzles 10 that spray the amorphous mass 3 onto a first area 2 of the surface of the strip 7 while it passes underneath the nozzles 10. The nozzles 10 may be stationary or movable transverse to the transport direction of the sheet metal strip 7. One skilled in the art will recognize that the spray nozzles 10 may be replaced with a roll (not shown). The roll may feature conventional gravure printing recesses that are filled with the amorphous mass 3 applied onto the roll with the aid of a doctor blade, while non-recessed surface areas of the roll do not contain the mass 3. The recesses are pre-formed in such a way that the mass 3 is transferred to the strip surface when it comes in contact with the strip 7 and the first area 2 is produced.

The application of the amorphous mass 3 onto a first area 2 of the surface of the sheet metal strip 7 by spraying is particularly suitable if the area 2 is composed of lines or elongate elements that extend in the direction of the longitudinal edges of the strip 7. The application of the amorphous mass 3 by rolls in accordance with the above-described modification is particularly suitable if the first area 2 features repeating elements in the longitudinal direction. It is also advantageous to roll on the amorphous mass if the first area 2 features elongate elements transverse to the transport direction. The exemplary distributions of the amorphous mass 3 on the surface of the metal sheet illustrated in FIGS. 2-4 can be used as examples.

After the application of the amorphous mass 3 onto the sheet metal strip 7, it passes through a furnace 11, in which it is subjected to a heat treatment, as illustrated in FIG. 6. During this process, the alloying element from the material is diffused into the first area 2 of the sheet metal strip 7 in a diffusion annealing process. In this case, an alloy of the sheet metal material and the alloying elements contained in the mass 3 is produced in the first area 2 while the second area 4 remains unalloyed. If possible, the time and the temperature of the diffusion annealing process are adjusted in such a way that complete diffusion of the alloying elements from the mass 3 into the sheet metal 1 is achieved. The heat treatment takes place under an inert gas atmosphere, for example nitrogen, in order to preclude undesirable reactions with atmospheric oxygen.

Downstream of the furnace 11, the sheet metal strip illustrated in FIG. 6 is transported between profiled roll pairs 23 that form the still hot sheet metal strip 7 in a roll-forming process. The sheet metal strip 7 is incrementally formed to the desired final cross section in a plurality of profiled roll pairs 23, of which only one is schematically illustrated in FIG. 6. The sheet metal strip 7 is continuously cooled during this process. A roll-forming process is advantageous when greater lengths of a profile should be manufactured.

Figure 7:
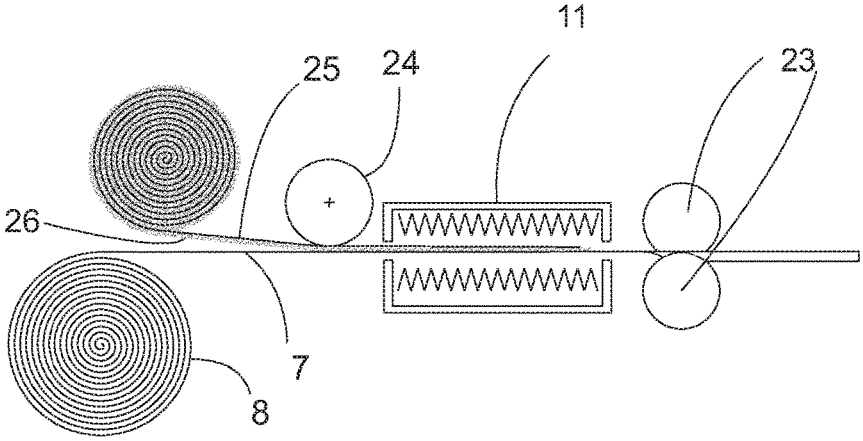
FIG. 7 shows the treatment of sheet metal according to a third embodiment the method.

FIG. 7 shows a treatment of sheet metal according to a third embodiment of the method. In this case, the sheet metal to be processed is initially supplied in the form of a sheet metal strip 7, which is wound into a coil 8 analogous to the second embodiment. A strip-shaped, coated carrier foil 25 is also supplied in the form of a coil. A thin layer of a material 26 containing an alloying element is locally applied onto one side of the carrier foil 25. The sheet metal strip 7 and the coil of the carrier foil 25 arranged on top thereof are gradually unwound. The sheet metal strip 7 and the carrier foil 25, the coated side of which faces the sheet metal surface, jointly pass underneath a pressing roll 24. During this process, the carrier foil 25 is pressed against the surface of the sheet metal strip 7 by the roll 24. The carrier foil 25 is rolled on under high pressure such that the material 26 comes into intimate contact with the sheet metal surface.

The material 26 may be applied onto the carrier foil 25 by means of vapor deposition. The material 26 contains the alloying element in the pure form or in the form of a compound that releases the alloying element. If several alloying elements are provided, the material 26 may consist of an alloy of the different alloying elements or the alloying elements may consist of respective layers of one of the alloying elements that lie on top of one another.

The alloying element may include carbon if the metal sheet strip 7 is a steel sheet. However, other alloying elements such as nitrogen, manganese, silicone, chrome, nickel or combinations thereof with or without carbon may also be considered. If the metal sheet strip 7 includes a different metal such as low alloy aluminum, preferably of an alloy group 1xxx, the alloying element may include copper, zinc, magnesium, silicone, manganese, lithium or combinations thereof.

The application of the material 26 with the aid of a coated carrier foil 25 is particularly suitable if the first area 2 is composed of shapes or lines that have varying widths transverse to the transport direction of the sheet metal strip 7 and therefore also cannot be rationally produced by spray nozzles 10 if they are movable transverse to the transport direction of the sheet metal strip 7. A carrier foil 25 also makes it possible to apply the material 26 in a very small quantity, which only diffuses into the sheet metal strip near the surface, in order to modify the properties of the surface of the sheet metal strip 7.

According to FIG. 7, the sheet metal strip 7 passes through a furnace 11, in which it is subjected to a heat treatment analogous to the second embodiment of the method, after the application of the coated carrier foil 25. During this process, the material of the carrier foil 25 decomposes and evaporates. The heat treatment preferably takes place under a vacuum in order to preclude undesirable reactions with decomposition products of the carrier foil 25 and atmospheric oxygen.

Downstream of the furnace 11, the sheet metal strip illustrated in FIG. 7 is transported between profiled roll pairs 23, which form the still hot sheet metal strip 7 in a roll-forming process analogous to the second embodiment of the method.

Individual areas of the one-piece sheet metal parts can be provided with material properties that are purposefully adapted to the respective function of these areas by adapting the division of the sheet metal to be processed into first and second areas to the shape of sheet metal parts to be produced thereof. For example, an area of the sheet metal part that should have a supporting function, but is not directly connected to another part, can be hardened by means of alloying while the original weldability and/or ductility is preserved in another area of the sheet metal part intended for being connected to other parts.

Figure 8:
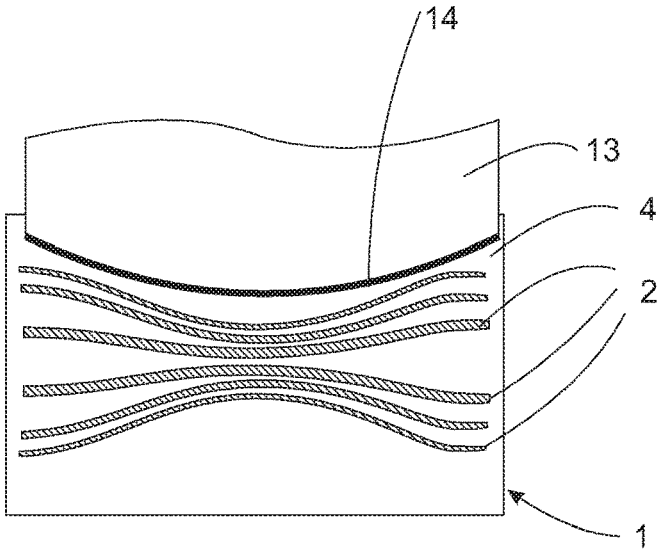
FIG. 8 shows a top view of a product for a first exemplary embodiment.

FIG. 8 shows a product that is assembled of a metal sheet 1 treated in the method according to FIG. 1 or a blank produced thereof and an attachment part 13. The metal sheet 1 includes a low alloy steel sheet, preferably of IF-steel, and the alloying element includes carbon. The attachment part 13 is welded to the second area 4 of the metal sheet 1 by means of a welding seam 14. The fact that the carbon equivalent in the second area 4 is lower than in the first area 2 and superior welding conditions therefore exist in the second area 4 is advantageously utilized in this case. High load characteristics are simultaneously achieved in the first area 2 and provide the product as a whole with great strength.

Figure 9:
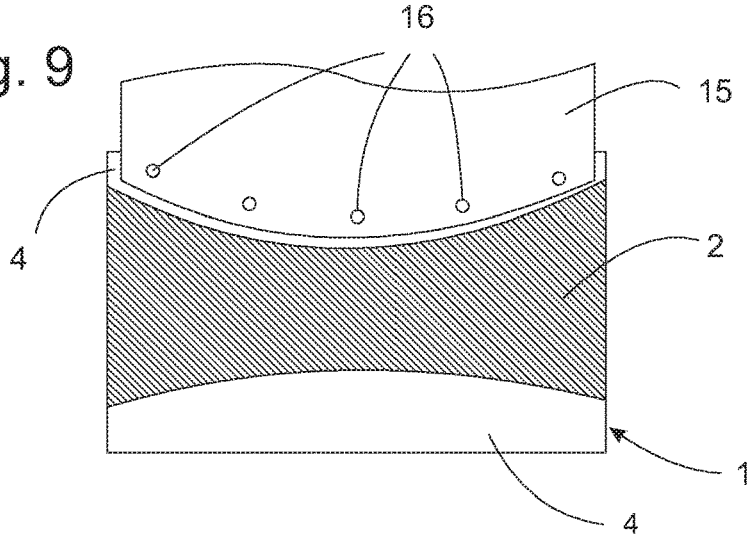
FIG. 9 shows a top view of a product for a second exemplary embodiment.

FIG. 9 shows a product for a second exemplary embodiment, in which the metal sheet 1 or a blank produced thereof and an attachment part 15 are fastened on one another. In this case, the strength in the first area 2 of the metal sheet 1 is also increased by means of an alloying element originating from the applied material. This not only complicates a welding process, but also the use of other connecting techniques. Consequently, punch rivets 16 for connecting the metal sheet 1 to the attachment part 15 are positioned in the unalloyed second area 4 of the metal sheet 1, in which the ductility is higher and the cracking tendency during the punching process is lower than in the first area 2.

Figure 10:
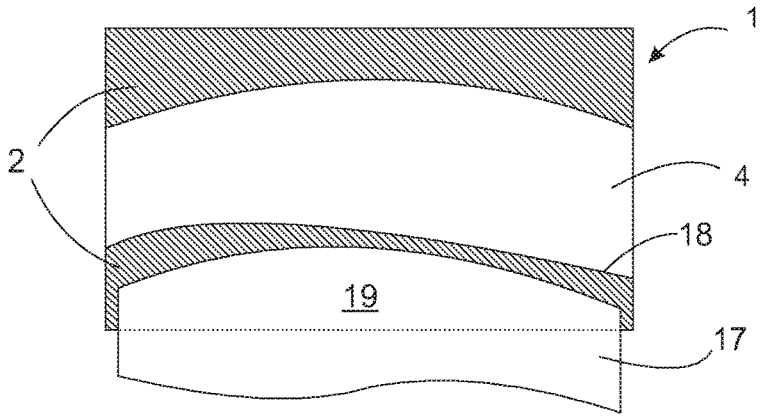
FIG. 10 shows a top view of a product for a third exemplary embodiment.

FIG. 10 shows a product for a third exemplary embodiment, in which the metal sheet 1 or a blank produced thereof and an attachment part 17 are fastened on one another by bonding the attachment part 17 to the first area 2 of the metal sheet 1 in a contact area 19, wherein it is assumed that galvanic contact between the metal sheet 1 and the attachment part 17 is locally produced in the contact area 19. The metal sheet 1 includes a low alloy steel sheet and the attachment part 17 is a stainless steel part. The attachment part 17 has a higher standard potential than the second area 4 of the metal sheet. In order to approximate the standard potential of the first area 2 to the standard potential of the attachment pan 17, chrome or chrome and/or nickel is alloyed into the first area 2. In this case, it suffices to increase the alloying concentration near the surface only as in FIG. 7*b*.

The approximation to the standard potential of the attachment part 17 in the first area 2 is particularly advantageous if the metal sheet 1 and the attachment part 17 are provided with a full-surface coating. Since coating flaws particularly occur in the connecting area between the metal sheet 1 and the attachment part 17 that is usually difficult to access, differences in the standard potential frequently lead to corrosive damages in the connecting area. Such corrosive damages are prevented due to the approximation of the standard potentials. The boundary 18 between the first area 2 and the second area 4 of the metal sheet 1 should be positioned sufficiently far from the contact area 19 between the first area 2 and the attachment part 17 in order to be easily accessible and to allow the application of a flawless coating that prevents contact corrosion at this boundary 18. To this end, it is proposed, in particular, that the distance between the boundary 18 and the contact area 19 amounts to at least 50 mm over its entire length. In the above-described exemplary embodiments, the blank may also be produced of the sheet metal strip 7. The exemplary embodiments are not limited to the cited materials and alloying elements.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method for processing a metal sheet to create a product of a designated shape, the method comprising:

identifying, based on load characteristics of the product a load area of the product that is configured to carry a load;

applying a material, as a number of separated strips, onto a first area of a surface on the metal sheet such that a second area of the surface is kept free of the material, wherein the material contains at least one alloying element;

subsequent to the application of the material, heat-treating the metal sheet such that the alloying element diffuses into the first area of the metal sheet; and forming the metal sheet into the designated shape with the first area corresponding to the load area.

2. The method according to claim 1, wherein the heat treatment is carried out in a furnace configured to promote diffusion of the alloying element from the material into the first area, without diffusion of the material into the second area.

3. The method according to claim 1, wherein the forming comprises forming the metal sheet in a forming tool into a final cross section of the product; and further comprising cooling the metal sheet during a cooling phase that follows the heat-treating, without reheating of the metal sheet after the heat-treating.

4. The method according to claim 3, wherein the forming and cooling comprises cooling the metal sheet through contact with the forming tool.

5. The method according to claim 1, wherein the material is applied to the metal sheet by a process selected from the group consisting of gravure printing, screen printing, or spraying.

6. The method according to claim 1, wherein the material is applied wet, and further comprising stacking a plurality of blanks of the metal sheet before the material has dried; and transferring the material from the surface to an adjacent one of the blanks by contact.

7. A method for treating sheet metal to form a product from a metal sheet, the method comprising:

identifying a first area of the metal sheet intended to correspond to a load area of the product, said load area having a higher load characteristic than a second area of the product and configured to carry a load;

applying a material, as a number of separated strips which comprise the first area, onto a surface of the first area such that a second area of the surface is kept free of the material, wherein the material contains at least one alloying element;

subsequent to application of the material, heat-treating the metal sheet such that the alloying element diffuses into the first area of the metal sheet;

forming the metal sheet into a final cross section of the product via roll forming the metal sheet by passing the metal sheet in a longitudinal direction through profiled roll pairs, wherein the separated strips extend in the longitudinal direction, and resulting in the first area corresponding to the load area; and continuously cooling the metal sheet during the forming by contact with the profiled roll pairs.

8. The method according to claim 7, comprising:

preparing the metal sheet to join with an attachment part; and matching a first standard potential of the first area with a second standard potential of the attachment part by selection of the alloying element to minimize contact corrosion when the first area contacts the attachment part.

* * * * *